United States Patent [19]

Warren

[11] Patent Number: 4,699,326

[45] Date of Patent: Oct. 13, 1987

[54] VERTICAL SHAFT IMPACT CRUSHER WITH SPLIT TUB

[75] Inventor: Gary R. Warren, Eugene, Oreg.

[73] Assignee: Cedarapids, Inc., Cedar Rapids, Iowa

[21] Appl. No.: 804,338

[22] Filed: Dec. 5, 1985

Related U.S. Application Data

[63] Continuation of Ser. No. 623,520, Jun. 22, 1984, abandoned.

[51] Int. Cl.[4] ..... B02C 19/00

[52] U.S. Cl. ..... 241/275; 241/285 R; 29/426.1

[58] Field of Search ..... 241/5, 225, 285 A, 285 B, 241/285 R; 29/426.1

[56] References Cited

U.S. PATENT DOCUMENTS

| | | | |
|---|---|---|---|
| 1,636,033 | 7/1927 | Agnew . | |
| 1,656,756 | 1/1928 | Payne . | |
| 1,941,770 | 1/1934 | Welsford et al. . | |
| 2,259,939 | 10/1941 | Garcia . | |
| 2,494,999 | 1/1950 | Halkins . | |
| 2,580,579 | 1/1952 | Neenan . | |
| 2,651,470 | 9/1953 | Dodds . | |
| 2,906,465 | 9/1959 | Sweet . | |
| 2,937,815 | 5/1960 | Eirich et al. | 241/285 R |
| 2,991,949 | 7/1961 | Sellars . | |
| 3,065,919 | 11/1962 | Burkett et al. . | |
| 3,149,790 | 9/1964 | Hoffstrom . | |
| 3,606,182 | 9/1971 | Warren . | |
| 3,873,047 | 3/1975 | Johnson | 241/275 |
| 4,167,251 | 9/1979 | Burr et al. | 241/275 X |

FOREIGN PATENT DOCUMENTS

| | | | |
|---|---|---|---|
| 28286 | 4/1907 | Austria | 241/286 |
| 13593A | of 1907 | United Kingdom . | |

*Primary Examiner*—Timothy V. Eley

*Attorney, Agent, or Firm*—Simmons, Perrine, Albright & Ellwood

[57] ABSTRACT

A vertical shaft impact crusher features a split tub such that the upper portion carrying the anvil ring and anvils can be removed as a unit and inverted on the ground for fast and easy anvil removal. The upper tub portion can also be rotated relative to the lower portion in order to even out anvil wear quickly and effectively.

16 Claims, 3 Drawing Figures

FIG 1
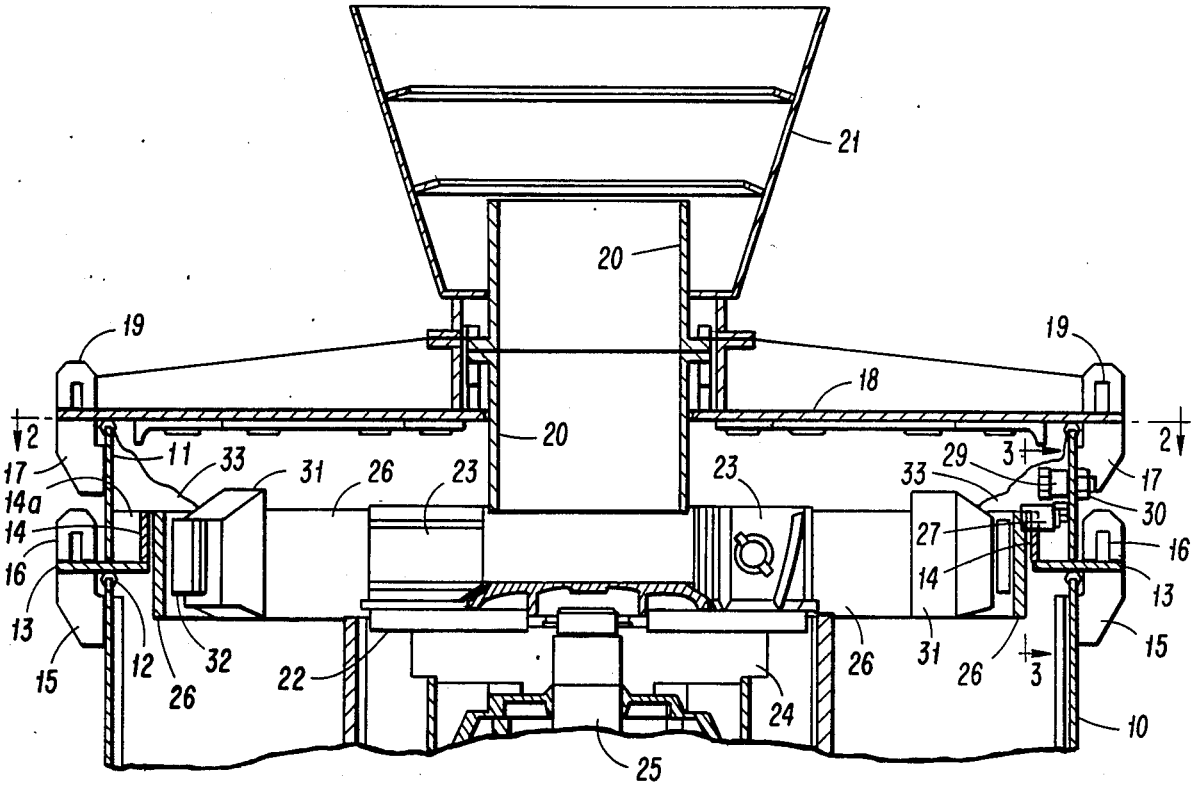
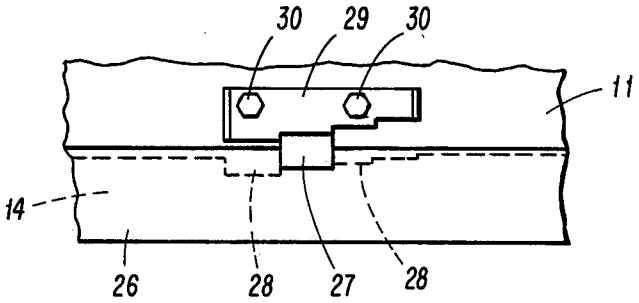
FIG 3

VERTICAL SHAFT IMPACT CRUSHER WITH SPLIT TUB

CROSS REFERENCE TO RELATED APPLICATION

This application is a continuation of application Ser. No. 623,520, filed June 22, 1984, and now abandoned.

BACKGROUND OF THE INVENTION

The present invention concerns rock crushers and particularly impact crushers of the vertical shaft type.

As is well known, the anvils in a vertical shaft impact crusher wear at a rate second only to the impeller shoes and so must also be replaced at periodic intervals. Typically the anvils are carried by an anvil ring seated within the upper end of the crusher housing or "tub", as it is often called. But fine and coarse rock, angular and sharp edged from fracturing, accumulates on top and behind the anvils and the anvil ring. So densely packed does the accumulation become that removal of the anvils and the anvil ring is both difficult and time consuming. After removing the crusher lid it often needs two men with hammers and bars up to one hour to chip away the accumulation before the ring and anvils can be detached. Even a single rock can bar removal of the anvil ring.

Not only must the anvils be replaced when worn out but for economy's sake they must also be rotated. As is likewise well known, the anvils wear unevenly, those in one sector abrading the least, the wear on the remaining anvils graduating between the two extremes. It is not uncommon to have a 30% to 50% difference between the most and least worn anvils. The reason for this, as will be explained more fully later on, has to do with the nature of the feed tube carried by the crusher lid, as well as with the direction of the feed into the hopper from the conveyor. Usually the crusher operator first replaces the most worn anvils, after having excavated the accumulation of rock above them as previously described. Some anvils will have remaining wear life but often the operator will also replace those anyway rather than endure the down time involved in replacing them a few days later. There is then not only a mismatch, unworn and worn anvils in the crusher, but it is most difficult afterwards, until a complete set of new anvils is installed, to arrange anvil replacement in order that all anvils are equally worn before they are discarded. This is because the next anvils needing replacement are among those of graduated wear between the most and least worn, again causing a mismatch. When the least worn at last must be discarded there is approximately 30% to 50% wear on those which first replaced the most worn anvils. At this time it is common to exchange the least worn anvils for the most worn ones either by moving them individually or by rotating the anvil ring 180°. But however rotation of the anvils is performed in current practice, manual labor is required to knock out the accumulated rock above. Even then it is often still difficult or impossible as a practical matter either to rotate the anvil ring in place or to remove it for rotation because of liming, corrosion and the like between the anvil ring and the tub in which the ring is seated. Hence, in most cases the anvils must be individually removed from the anvil ring and replaced 180° from their previous location.

Accordingly, the primary object of the invention is the provision of a vertical impact crusher in which the anvils can be replaced and/or the anvil ring and anvils as a unit easily rotated to even out anvil wear, all with a minimum of time and labor.

SUMMARY OF THE INVENTION

The aim of the invention is achieved by, in effect, splitting the tub behind the anvil ring (where no rock accumulates) into upper and lower portions or tubs and securing the anvil ring or other anvil retaining means to the upper tub only. Hence, after removal of the lid and hopper, the upper tub complete with the anvil ring and anvils can be lifted off (by a crane) as a unit from the lower tub and inverted on the ground. When this is done, it has been found in practice, the mere inversion of the upper tub and the attendant jars as it strikes the ground very effectively dislodges all the accumulated rock. Especially when the anvils are of the liftout type, being retained by gravity in wedging seats, inversion of the upper tub allows the individual anvils to be easily removed. At most, only a blow or two by a hammer is necessary.

Another feature inherent in the split tub design is the ability to rotate all the anvils as a unit so as to even out anvil wear without the need to remove individual anvils or to lift out the anvil ring from within the tub in order to do so. After, say 30% to 50% wear of the anvils in the heavy wear sector, the lid and hopper are removed and then the upper tub and anvils as a unit rotated 180°, thus placing the least worn anvils in the heavy wear sector and the most worn anvils in the least wear sector, the two sets of anvils between those two sectors thus being reversed in graduation of wear. Thereafter operation of the crusher will largely even out anvil wear until all the anvils are nearly equally worn to the prescribed limit. All the anvils are then ready for replacement in the manner previously described by lifting off the upper tub and inverting it on the ground. Obviously, the saving in time and labor and in anvil utility and economy is substantial compared with current practices.

The features and advantages of the present invention will become more apparent from the drawings and the more detailed description which follows.

BRIEF DESCRIPTION OF THE DRAWINGS

FIG. 1 is a vertical section, taken approximately along the line 1—1 of FIG. 2, through the upper half of a vertical shaft impact crusher embodying the features of the invention.

FIG. 3 is a detail view taken along the line 3—3 of FIG. 1.

DETAILED DESCRIPTION OF THE PREFERRED EMBODIMENT

Figure 2:
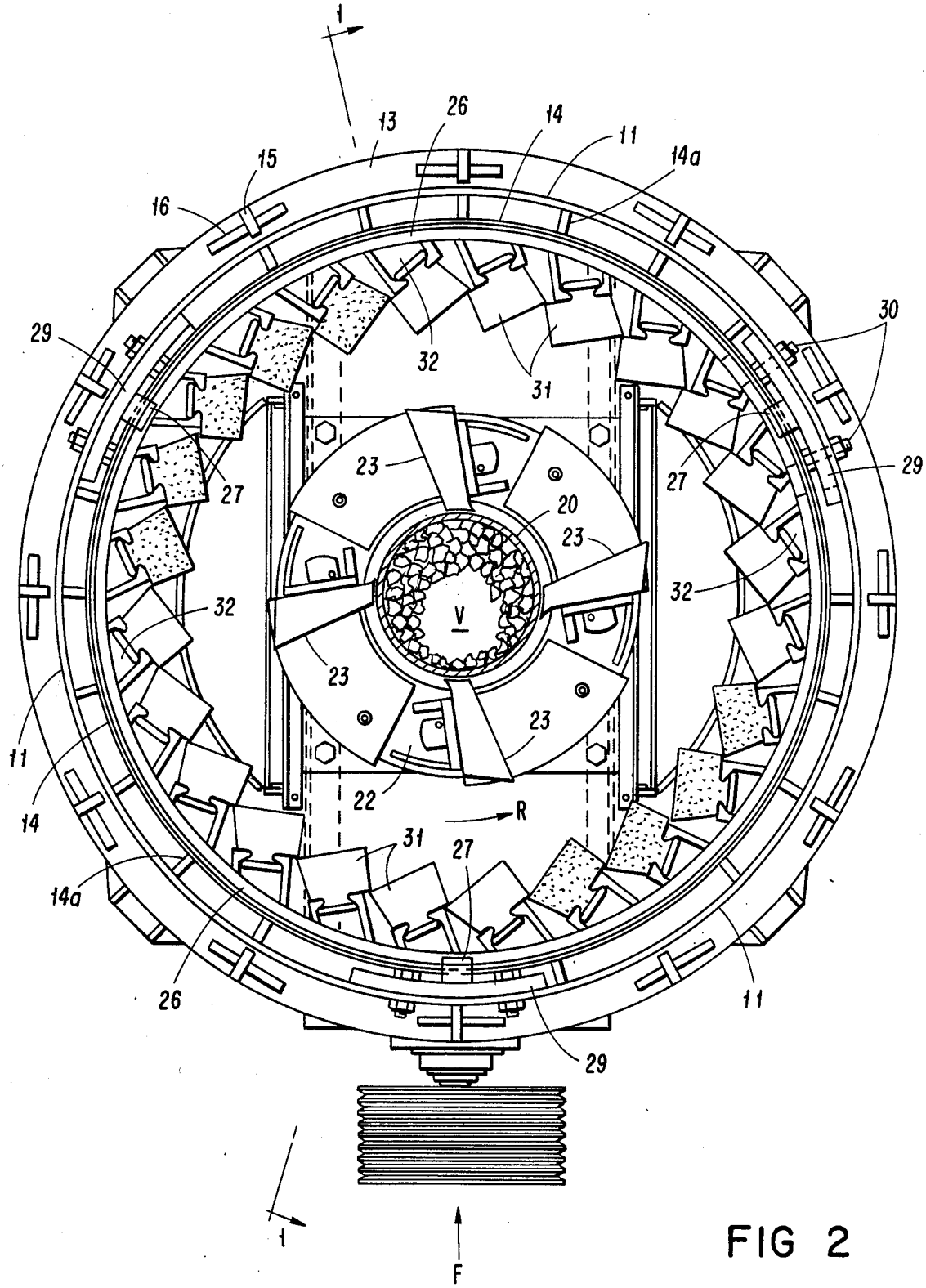
FIG. 2 is a sectional view taken along the line 2—2 of FIG. 1 and also illustrating the disposition of the gradations of anvil wear relative to the direction of material feed into the crusher.

The construction of the crusher is basically quite conventional, the essential difference being the cylindrical housing which is split into a lower tub 10 and an upper tub 11. The upper edge of the lower tub 10 is surmounted by a gasket 12 upon which seats an annular flange plate 13 forming the base of the upper tub 11. The inner annular edge of the plate 13 is encircled by an upstanding annular anvil ring support 14 which is braced against the inner wall of the upper tub 11 by short radial gusset plates 14*a*. The lower and upper tubs 10 and 11 are secured together by an array of equally spaced or indexed upstanding wedge tangs 15 welded to the exterior of the lower tub 10 adjacent its top edge, the tangs 15 extending up through slots in the flange plate 13 and apertured thereabove to receive elongated wedges 16. Similar upstanding wedge tangs 17 are secured adjacent the top edge of the upper tub 1 and extend up through open ended slots in the rim of a circular lid 18, the tangs 17 also being apertured thereabove to receive elongated wedges 19. The latter and wedges 16 thus secure the lower and upper tubs 10 and 11 and the lid 18 together during operation of the crusher.

The lid 18 is centrally apertured to receive a conventional cylindrical feed tube 20 surrounded by a feed hopper 21, both secured to the lid 18. The feed tube 20 extends down below the lid 18 and opens on to a typical circular impeller table 22 fitted with replaceable impeller shoes 23 outboard of the feed tube 20. The impeller table 22 is secured atop a fly wheel 24 driven by a vertical main shaft 25 in any suitable manner. The anvil ring support 14 embraces an anvil ring 26 which is supported therewithin by a trio of short lugs 27 welded atop the ring 26 and extending radially outwards therefrom. The lugs 27 sit in corresponding ones of several steps 28 cut into the top of the ring support 14 (see FIG. 3) and are retained by complementary stepped blocks 29 bolted at 30 to the adjacent inner wall of the upper tub 11. The inner face of the anvil ring 26 carries a circle of anvils 31 retained by gravity in wedging sockets 32 welded to the anvil ring 26, all as is typcal. Note that the anvil ring 26 is disposed such that the joint between the tubs 10 and 11 is behind the ring 26. This protects the gasket 12 from abrasion by dust swirling below in the tub 10. Vertical adjustment of the anvils 31 is accomplished by removing the blocks 29 and then lifting and rotating the anvil ring 26 until the lugs 27 sit upon the steps 28 of the desired elevation, whereafter the blocks 29 are reinstalled.

Accordingly, when the anvils 31 are to be changed the lid wedges 19 are removed and the lid 18 lifted off. Then the tub wedges 16 are removed and the entire upper tub 11 together with the anvils 31 is lifted off and inverted on the ground. The accumulated rock above the anvil ring 26, indicated at 33 in FIG. 1, is thereby sufficiently jostled so that it largely falls free to the ground. If the anvils 31 do not then also fall free of their own accord from their wedging sockets 32, no more than a blow or two from a hammer will dislodge them. When the upper tub 11 is righted, fresh anvils 31 can be dropped into their sockets 32 and the upper tub 11 and lid 18 reassembled on the crusher.

The phenomenon of unequal wear of the anvils 31 is indicated in FIG. 2. Assuming that feed into the hopper 21, as from a conveyor, is in the direction of the arrow F, the descending rock in the feed tube 20 will form a sort of vortex V eccentric to the crusher's axis, much like water down a drain, with the center line of the greatest and least quantities of material lying in the direction of feed F, the greatest quantity being disposed away from and the least toward the incoming material. Assuming also that the direction of rotation of the impeller table 22 is as shown by the arrow R, of the material flung outwards by the impeller shoes 23 the greatest quantity will therefore strike the anvils 31 in the 9:30 to 11:30 o'clock position, and the least amount the anvils 31 in the 3:30 to 5:30 o'clock position, relative to the orientation of FIG. 2, as indicated by the two groups of stippled anvils 31 in that Figure. Hence the wear on the former anvils will be greatest and that on the latter least. Put another way, the center line of the area of greatest anvil wear forms an obtuse included angle, and the center line of least anvil wear an acute included angle, with and on opposite sides of the direction of feed F. Anvil wear between these two diametrically opposite locations graduates from the greatest to the least.

The difference in anvil wear between the greatest and the least can be substantial. For instance, after 133 hours of operation of an actual crusher embodying the invention, 2-5/16 inches were worn from the anvils in the area of greatest wear but only 1¼ to 1-5/16 inches from those in the area of least wear. At that time, the wedges 16 were removed and the upper tub 11 and lid 18 lifted and rotated 180°, thus reversing the relative positions of the anvils. After reassembly and an additional 218 hours of operation, the wear on all the anvils was nearly equal, varying from 3-9/16 to 3-5/16 inches. Hence by simply rotating the upper tub 11 from time to time, without need to disturb the anvil ring or to remove the anvils individually, anvil wear can be kept relatively equal until all are worn to the limit. All anvils can then be replaced at once, in the manner previously described, rather than only piecemeal and with the difficulties inherent in the prior art. The consequent savings in down time and anvil cost are obvious. Note that the upper tub 11 need not be rotated 180° each time but, owing to the equal spacing of the wedge tangs 15, lesser degrees of rotation are available in order, for instance, to accommodate a change in the direction of feed F and thus a change in the areas of greatest and least anvil wear.

Though the present invention has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. In a crusher of the kind described including a stationary housing having an upright cylindrical wall with an axis and a removable lid closing the upper end of the housing, a plurality of individual anvils within the housing circumferentially disposed in a ring within and concentric with the housing wall, the anvils being retained in position in anvil retaining means carried by the housing wall and individually removable from the crusher after removal of the lid by upward movement of each anvil relative to the anvil retaining means, the improvement wherein the housing comprises upper and lower portions, the anvil retaining means being carried by the upper portion, the upper housing portion being attached to the lower housing portion by releasable means effective so that upon release of the releasable means and removal of the lid the upper housing portion together with the anvils can be lifted as a unit from the lower housing portion and inverted on the ground to facilitate removal of the anvils from the anvil retaining means.

2. The crusher of claim 1 wherein the anvils are retained in the anvil retaining means at least in part by gravity.

3. In a crusher of the kind described including a stationary housing having an upright cylindrical wall with an axis a removable lid closing the upper end of the housing, and a plurality of individual anvils within the housing circumferentially disposed in a ring within the housing wall, the anvils being retained in position by means carried by the housing wall and individually removable from the crusher after removal of the lid without disassembly of the crusher housing, the improvement wherein the housing comprises upper and lower portions, the anvil retaining means being secured to the upper portion, the upper housing portion being attached to the lower housing portion by releasable means effective so that upon release of the releasable means the upper housing portion together with the anvils can be moved as a unit from an initial position on the lower housing portion to at least one other position thereon rotatably disposed with respect to the housing axis from said initial position.

4. The crusher of claim 3 wherein after release of the releaseable means the upper housing portion and the anvils can be moved to any one of a plurality of uniformly indexed other positions on the lower housing portion rotatably disposed with respect to the housing axis from said initial position.

5. In a crusher of the kind described including a stationary housing having an upright cylindrical wall with an axis and a removable lid closing the upper end of the housing, a plurality of individual anvils within the housing circumferentially disposed in a ring within and concentric with the housing wall, the anvils being retained in position by means carried by the housing wall and individually removable from the retaining means after removal of the lid by upward movement relative thereto without need to disassemble the crusher housing, the improvement wherein the housing comprises upper and lower portions, the anvil retaining means being attached to the upper portion, the upper housing portion being secured to the lower housing portion by releasable means effective so that upon release of the releasable means the upper housing portion together with the anvils can be both lifted as a unit from an initial position on the lower housing portion and replaced back onto the lower housing portion in at least one other position thereon rotatably disposed with respect to the housing axis from said initial position.

6. The crusher of claim 5 wherein after lifting of the upper housing portion and the anvils as aforesaid the same can be replaced back onto the lower housing portion in any one of a plurality of uniformly indexed other positions thereon rotatably disposed with respect to the housing axis from said initial position.

7. The crusher of claim 5 wherein the anvils are retained in the anvil retaining means by gravity, whereby upon removal of the lid and inversion of the upper housing portion and the anvils on the ground after lifting of same as aforesaid the anvils may be individually removed from the anvil retaining means.

8. The crusher of claim 7 wherein after removal of individual anvils and replacement of same following reinversion of the upper housing portion, the latter and the anvils may be replaced back onto the lower housing portion in any one of a plurality of uniformly indexed other positions thereon rotatably disposed with respect to the housing axis from said initial position.

9. A method of facilitating removal of the anvils from a crusher of the kind described after a period of crushing operation, the crusher including a housing having an upright cylindrical wall and a removable lid closing the upper end of the housing, a plurality of anvils within the housing circumferentially disposed in a ring within the housing wall, the anvils being retained in position in anvil retaining means carried by an upper portion of the housing wall and removable from the retaining means by upward movement relative thereto, the upper housing portion being attached to the remainder of the housing by releasable means, the method comprising: disconnecting the upper housing portion from the remainder of the housing by releasing the releasable means; removing the lid; and lifting the upper housing portion together with the anvils as a unit from the lower housing portion and inverting the same on the ground.

10. The method of claim 9 wherein the anvils are retained in the anvil retaining means at least in part by gravity so that upon inversion of the upper housing portion and the anvils on the ground after lifting of same as aforesaid the anvils may be individually removed from the anvil retaining means.

11. A method of distributing wear on the anvils of a crusher of the kind described resulting from crushing of material, the crusher including a housing having an upright cylindrical wall with an axis and a plurality of anvils within the housing circumferentially disposed in a ring within the housing wall, the anvils being retained in position by means carried by an upper portion of the housing wall, the upper housing portion being attached to the remainder of the housing by releasable means, the method comprising: disconnecting the upper housing portion from the remainder of the housing by releasing the releasable means; moving the upper housing portion together with the anvils as a unit relative to said housing remainder from an initial position on said housing remainder to at least one other position thereon rotatably disposed with respect ot the housing axis from said initial position; and re-attaching the upper housing portion to said housing remainder by resecuring the releasable means.

12. The method of claim 11 wherein the method further includes, after release of the releasable means, moving the upper housing portion and the anvils to any one of a plurality of uniformly indexed other positions on said housing remainder rotatably disposed with respect to the housing axis from said initial position.

13. A method of distributing wear on the anvils of a crusher of the kind described resulting from crushing of material, the crusher including a housing having an upright cylindrical wall with an axis and a removable lid closing the upper end of the housing a plurality of anvils within the housing circumferentially disposed in a ring within and around the housing wall, the anvils being retained in position by means carried by an upper portion of the housing wall and removable from the retaining means by upward movement relative thereto, the upper housing portion being attached to the remainder of the housing by releasable means, the method comprising: disconnecting the upper housing portion from the remainder of the housing by releasing the releasable means; lifting the upper housing portion together with the anvils as a unit from an initial position on said housing remainder; replacing the upper housing portion back onto said housing remainder in another postiion thereon rotatably disposed with respect to the housing axis from said initial position; and re-attaching the upper housing portion to said housing remainder by re-securing the releasable means.

14. The method of claim 13 wherein the method further includes, after lifting of the upper housing portion and the anvils as aforesaid, replacing the same back onto said housing remainder in any one of a plurality of uniformly indexed other positions thereon rotatably disposed with respect to the housing axis from said initial position.

15. The method of claim 13 whrein the anvils are retained in the anvil retaining means by gravity, and wherein the method further includes removing the lid and inverting the upper housing portion and the anvils on the ground after release of the releasable means and lifting of the upper housing portion as aforesaid, whereby removal of individual anvils from the anvil retaining means is facilitated.

16. The method of claim 15 wherein, after removal of individual anvils and replacement of same following reinversion of the upper housing portion, the method further includes replacing the upper housing portion onto said housing remainder in any one of a plurality of uniformly indexed other positions thereon rotatably disposed with respect to the housing axis from said initial position.

* * * * *